US005694159A

United States Patent [19]

Kajiya et al.

[11] Patent Number: 5,694,159

[45] Date of Patent: Dec. 2, 1997

[54] THERMAL PRINTER

[75] Inventors: Hiroshi Kajiya, Tokyo; Sakae Takeuchi, Saitama-ken, both of Japan

[73] Assignee: Kabushiki Kaisha Sato, Tokyo, Japan

[21] Appl. No.: 701,040

[22] Filed: Aug. 21, 1996

Related U.S. Application Data

[63] Continuation of Ser. No. 406,675, Mar. 20, 1995, abandoned.

[30] Foreign Application Priority Data

Mar. 25, 1994 [JP] Japan ..... 6-077872

[51] Int. Cl.[6] ..... B41J 25/304; B41J 25/308; B41J 2/335

[52] U.S. Cl. ..... 347/197; 347/222

[58] Field of Search ..... 347/197, 222; 406/120.16

[56] References Cited

U.S. PATENT DOCUMENTS 5,366,302 11/1994 Masumura et al. ..... 347/197

FOREIGN PATENT DOCUMENTS 2241772 2/1990 Japan .

4-296569 10/1992 Japan ..... 347/222

*Primary Examiner*—Huan H. Tran

*Attorney, Agent, or Firm*—Ostrolenk, Faber, Gerb & Soffen, LLP

[57] ABSTRACT

In a thermal printer having a printer frame to which the thermal print head is swingable attached and supported on a print head holder, the orientation of the print head with reference to a platen roller is set and the print head is permitted to move with reference to the platen roller without changing their orientations. An engagement pin on the printer frame receives a fourth engaging member on the end of the thermal print head holder. A positioning pin on the print head holder is received in a positioning hole in the print head holder mounting plate. Fixing pins at each side of the first positioning pin are received in fixing holes in the mounting plate and are held there by fixing elements. The engaging pin and engaging member permit the print head holder to move with reference to the platen roller to accommodate different thickness papers.

12 Claims, 4 Drawing Sheets

THERMAL PRINTER

This is a Continuation of application Ser. No. 08/406,675 filed on Mar. 20, 1995 abandoned.

BACKGROUND OF THE INVENTION

1. Field of the Invention

The invention relates to a thermal printer, and more particularly to a thermal printer in which a thermal print head which is detachably attached to an openable head frame, prints on paper or another such printing medium pressed onto a platen roller by the print head.

2. Description of the Prior Art

In order to make it easy to insert paper into a thermal printer and to facilitate the removal of paper that becomes jammed in the printer, the thermal print head is usually mounted on a head frame that is openably supported on the printer body to thereby enable the thermal print head to be brought into contact with, and separated from, the platen roller.

The printing face of a print head consists of arrays of numerous heating elements that become worn after an extended period of use. Printers therefore are usually constructed in a way that enables the print head to be replaced. Japanese Patent Application No. HEI 2-241772 discloses an example of a thermal printer that facilitates replacement of the print head. In that printer, fixing pins provided at the back and front of the head holder and locating pins provided at each side toward the front of the head holder are inserted into corresponding fixing and positioning holes formed in a head frame mounting plate. The fixing pins each have a narrowed portion for engaging with V-shaped cutouts in a support plate urged by a spring in one direction on the surface of the mounting plate, thus permitting the thermal print head to be detachably mounted on the head frame.

However, to maintain good print quality the print head has to be correctly positioned with respect to the platen roller. A thermal printer in which the print head can be brought into contact with, and separated from, the platen roller, and in which the print head is readily detachable to facilitate replacement, is highly convenient with respect to setting the paper in position and replacing the print head. However, a drawback is that the print head can easily move out of alignment with the platen roller, resulting in misprinting. Misalignment of the opening and closing action of the print head support frame, for example, can result in contact position misalignment of the print head relative to the platen roller. As shown in another arrangement, disclosed in Japanese Patent Application No. HEI 2-241772, when a construction is used in which the print head is detachably attached to the head frame, the difficulty of attaching the head rigidly to the head frame can result in misalignment of the head relative to the platen roller. It is particularly easy for this misalignment to be caused during printing by the rotational action of the platen roller or by the paper transport operation. Thus, a drawback of this type of conventional thermal printer is that misprinting can readily occur, making it difficult to obtain good quality printing.

An object of the present invention is to provide a thermal printer in which the thermal print head can be correctly positioned with respect to the platen roller, thereby preventing misprinting.

SUMMARY OF THE INVENTION

The summary refers to the accompanying drawings. To achieve the above object, this invention provides a thermal printer having an engaging pin 66 at each lateral end of a printer frame 14 and a thermal print head 24 detachably mounted on an openable head frame 34. The thermal print head is brought into contact with a platen roller 26 to print paper 11 therebetween. A thermal print head holder 52 has an engaging member 68 at each end, a positioning member 54 located in the center portion, and a fixing member 56 at each side of the positioning member 54.

Misprinting is prevented and print quality is improved by providing a head holder mounting plate 42 with a positioning hole 44 corresponding to the positioning member 54 and fixing holes 46 corresponding to the fixing members 56. The relative positions of platen roller 26 and thermal print head 24 are set by a first positioning mechanism comprising engagement of engaging members 68 with engaging pins 66. The position of contact between the platen roller 26 and the thermal print head 24 is set by a second positioning mechanism comprising insertion of the positioning member 54 in the positioning hole 44. A fixing position is set by insertion of fixing members 56 in fixing holes 46.

In accordance with this invention, the relative positions of the platen roller 26 and the thermal print head 24 can be correctly set and the rotation of the thermal print head 24 can be restricted by means of the first positioning mechanism. Also, the position of contact of the thermal print head 24 on the platen roller 26 can be correctly set and thermal print head movement to the back, front or sides can be restricted by the second positioning mechanism. Accordingly, the thermal print head 24 can be correctly positioned relative to the platen roller 26. Moreover, as the thermal print head 24 is fixed and does not move during printing, misprinting does not occur.

Openings 70 in the engaging members 68 extend in the direction along which the platen roller 26 is pressed by the thermal print head 24 when the thermal print head 24 is brought into contact with the platen roller 26. Therefore, changing the thickness of the paper 11 only results in a vertical shift by the thermal print head 24 in the direction of pressure relative to the platen roller, so that the contact of the thermal print head 24 on the platen roller 26 can be maintained at a set angle.

Further features of the invention, its nature and various advantages will be more apparent from the accompanying drawings and following detailed description of the invention.

DESCRIPTION OF THE PREFERRED EMBODIMENT

A preferred embodiment of the thermal printer of this invention is now described with reference to the drawings.

Figure 1:
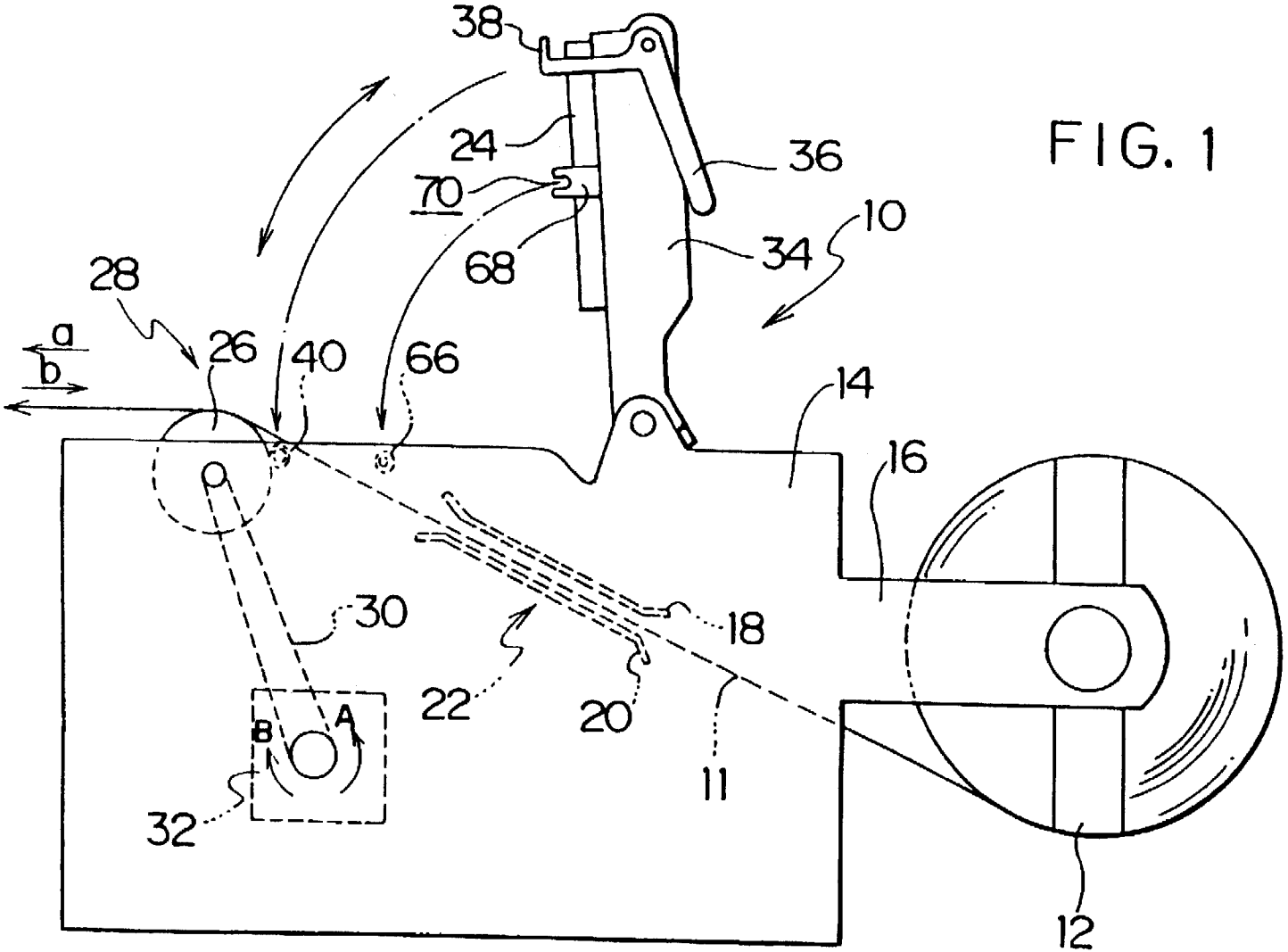
FIG. 1 is a general view of the thermal printer of this invention, with the thermal print head separated from the platen roller.
Figure 2:
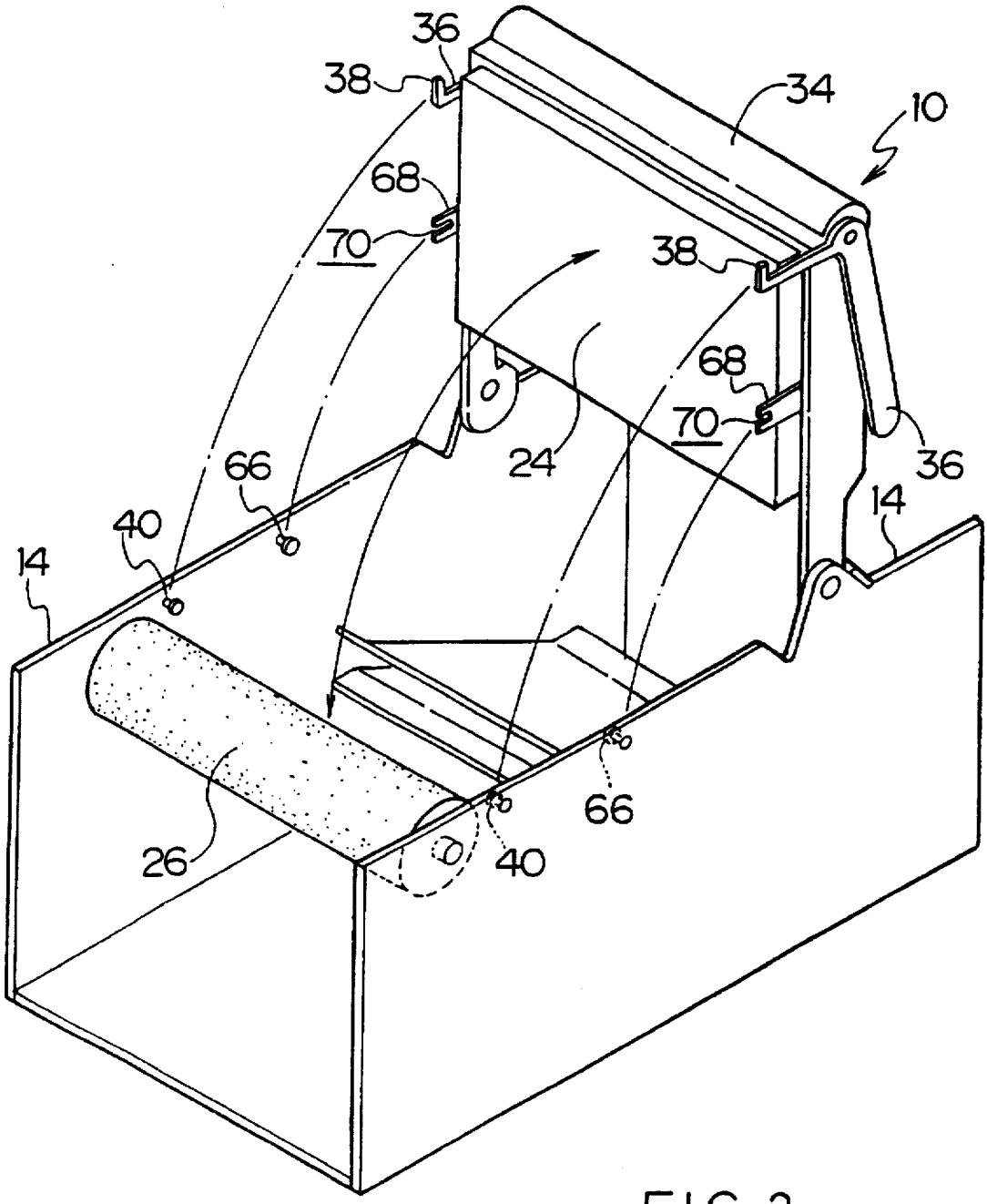
FIG. 2 is an enlarged, perspective view of the principal parts of the printer shown in FIG. 1.

FIG. 1 is a general view of a thermal printer 10 according to this invention, with the platen roller 26 separated from the thermal print head 24. FIG. 2 is a perspective view showing the principal parts of the arrangement of FIG. 1. As shown in FIG. 1, a supply reel 12 of paper 11, which serves as the printing medium, is rotatably supported at the ends of arms 16 which extend out from the rear side of the printer frame 14. A paper guide 22 comprised of upper and lower guide members 18 and 20 guides paper 11 supplied from the supply reel 12 for printing at a printing section 28 principally comprised of the thermal print head 24 and the platen roller 26. A timing belt 30 is provided between the platen roller 26 and a stepping motor 32 that can operate in forward or reverse. Rotation of the stepping motor 32 in the direction indicated in the drawing by A is transmitted to the platen roller 26 by the timing belt 30, whereby the platen roller 26 is rotated in a direction that causes the paper 11 to be fed in the direction indicated in the drawing by a. Conversely, rotating the stepping motor 32 in direction B causes the paper 11 to be fed backwards in direction b.

To facilitate the insertion of paper 11 into the thermal printer 10 and the removal of the paper 11 therefrom, such as when the paper jams, the thermal print head 24 is supported by a head frame 34 that can be freely opened to separate the thermal print head 24 from the platen roller 26 or that can be closed to press the print head 24 against the platen roller 26. When the thermal print head 24 is brought into contact with the platen roller 26 to perform printing, the head frame 34 is locked shut on the printer frame 14 by pivoting levers 36 so that hooked portions 38 on the end of the levers 36 hook onto pins 40 on the printer frame 14.

Figure 3:
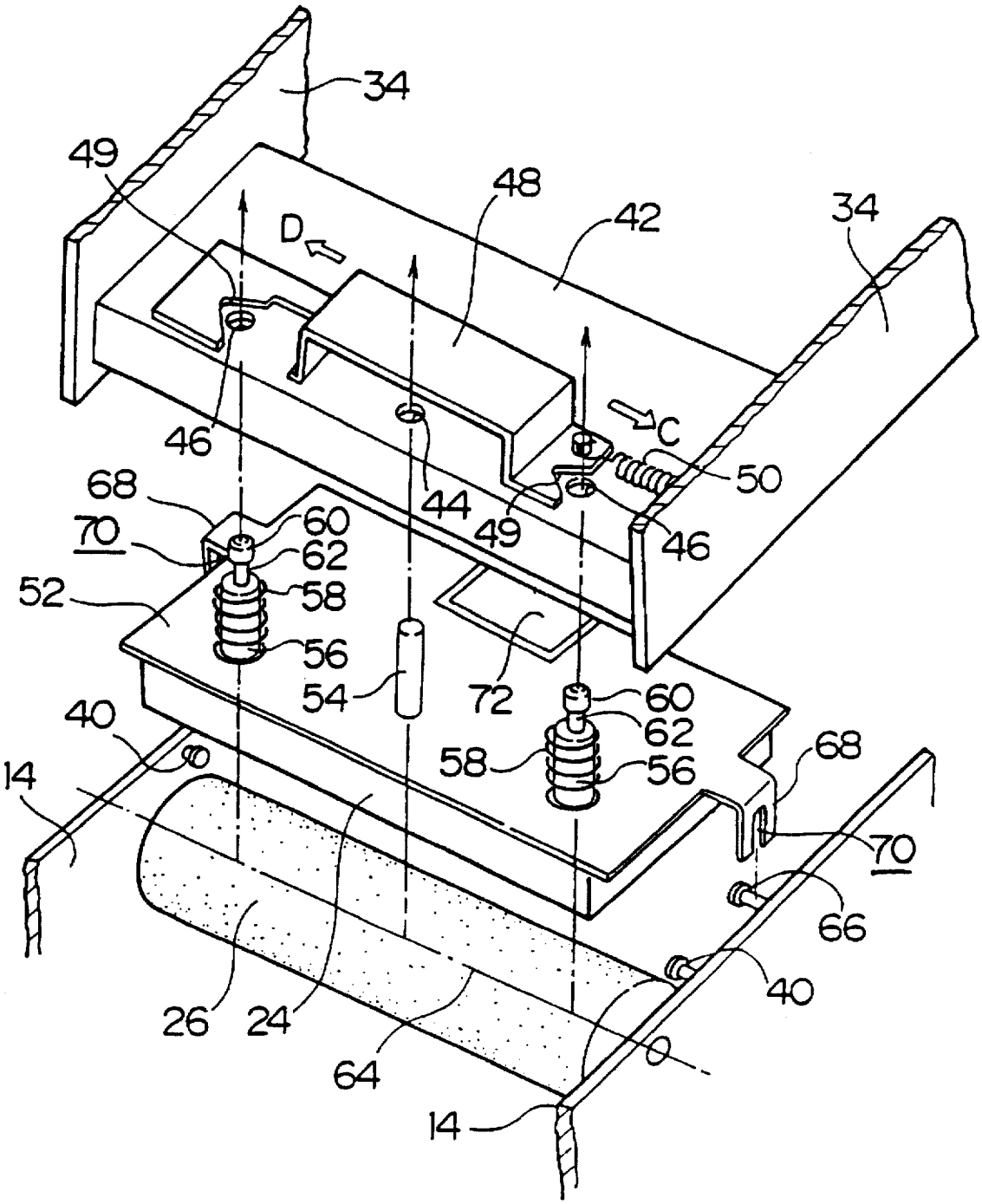
FIG. 3 is a perspective view showing the print head before it is attached to the head frame.
Figure 4:
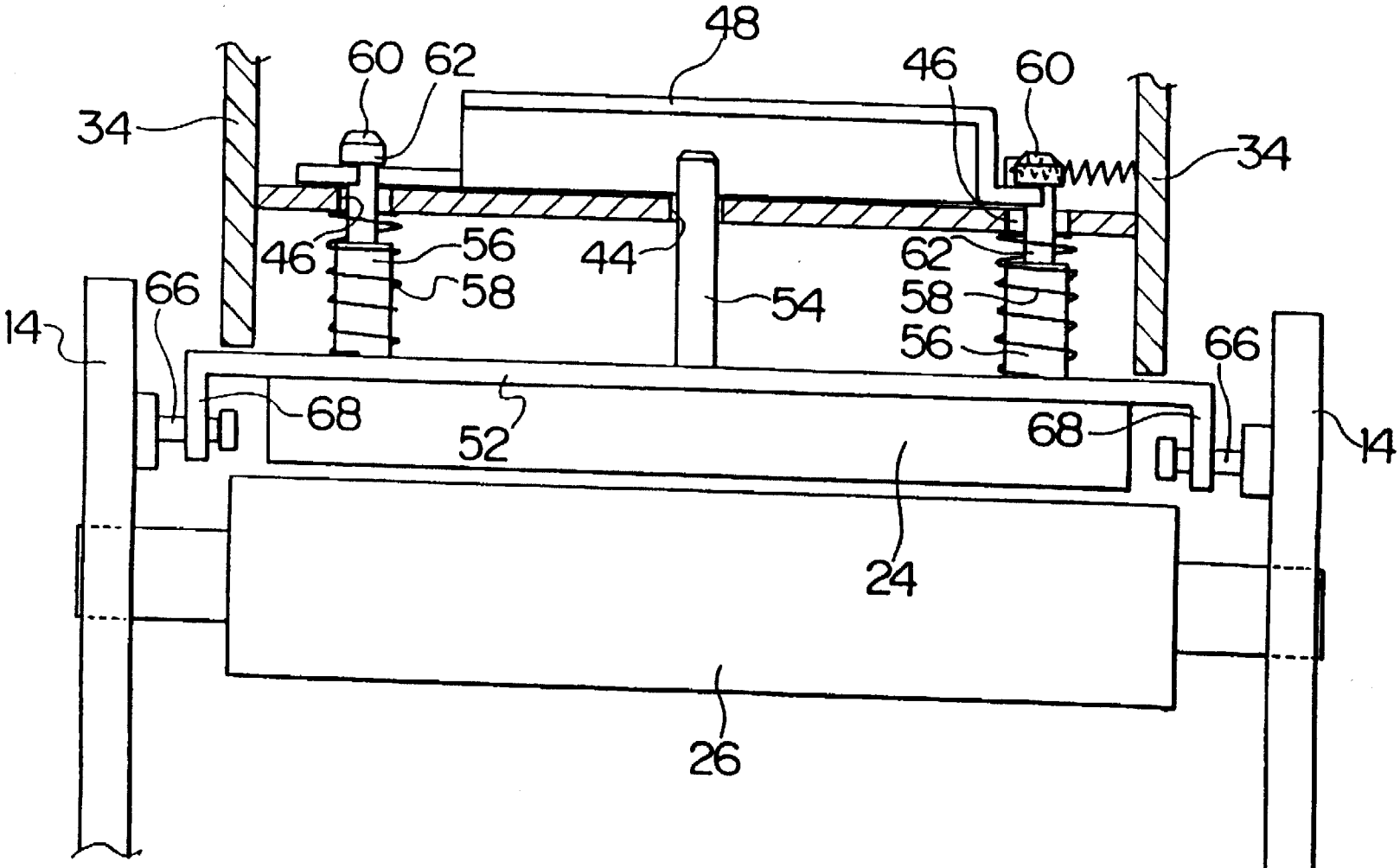
FIG. 4 is a front sectional view after the print head has been attached to the head frame.

The printing face of the thermal print head 24 is provided with numerous heating elements (not shown). These heating elements become worn after being used for extended periods of time. A structure is therefore used that enables the thermal print head 24 to be easily replaced when this wear causes the thermal print head 24 to malfunction. As shown in FIG. 3 (showing the print head 24 before it is mounted on the head frame 34) and FIG. 4 (after the thermal print head 24 is mounted on the head frame 34), the mounting plate 42 of the head frame 34 has a positioning hole 44 to enable the thermal print head 24 to be positioned correctly with respect to the platen roller 26. The positioning hole 44 is located toward the front of the mounting plate 42 at a point established during manufacture of the thermal printer 10. Fixing holes 46 are provided at either side of the positioning hole 44 in the width direction of the mounting plate 42 for affixing the thermal print head 24 to the mounting plate 42. There is also a fixing plate 48 provided on the mounting plate 42. One end of the fixing plate 48 is associated with the head frame 34 by a spring 50, and is thereby urged in direction C. A pair of V-shaped cutouts 49 are formed at prescribed locations in the fixing plate 48.

Provided on the face of the print head holder 52 are a positioning member 54 comprising a positioning pin (and hereinafter referred to as "positioning pin") and a pair of fixing members 56 constituted by fixing pins (and hereinafter referred to as "fixing pins"). The positioning pin 54 is located at a position corresponding to the positioning hole 44 and the fixing pins 56 are located at positions corresponding to the fixing holes 46. The fixing pins 56 are provided with compression springs 58 that urge the thermal print head 24 against the platen roller 26. The tip of each of the fixing pins 56 is formed in the shape of a truncated cone 60. Below each of the truncated cone portions 60 is a narrowed portion 62 having a smaller diameter than the truncated cone portion 60. The holes 44 and 46 and the pins 54 and 56 are arranged in a line so that when the thermal print head 24 is in contact with the platen roller 26, the force of the compression springs 58 acts perpendicularly with respect to the center axis 64 of the platen roller 26 (FIG. 3).

An engaging pin 66 is provided at each side of the printer frame 14 which supports the platen roller 26. These pins 66 are each located at a position established during the manufacture of the thermal printer 10 to ensure that when the thermal print head 24 is brought into contact with the platen roller 26, the thermal print head 24 is correctly positioned with respect to the platen roller 26. An engaging member 68 is provided toward the rear on each side of the head holder 52. These engaging members 68 are each in the general form of an inverted "U" with the space between the forks being in the form of an elongated opening 70 for engagement with the engaging pins 66, for which the openings 70 extend in the direction in which the thermal print head 24 is brought into contact with the platen roller 26. The positional arrangement of the positioning pin 54 and engaging members 68 forms an isosceles triangle generally in the plane of the holder 52 and with the positioning pin 54 at the apex. Preferably the positioning pin 54 and the engaging members 68 should extend substantially parallel. The engaging members 68 are thus symmetrically arranged with respect to the positioning pin 54.

The operation of the thermal printer 10 of this invention having the above configuration is now described.

First, the procedure for mounting the thermal print head 24 on the head frame 34 is explained. The thermal print head 24 is replaced with the head frame 34 opened while the thermal print head 24 is separated from the platen roller 26. With respect to FIGS. 3 and 4, the fixing plate 48 is moved in direction D against the force of the spring 50 and the positioning pin 54 and fixing pins 56 on the head holder 52 are inserted into the positioning hole 44 and fixing holes 46 in the mounting plate 42. The V-shaped cutouts 49 on the fixing plate 48 are then engaged with the narrowed portions 62 of the fixing pins 56. The fixing plate 48 is urged in direction C by the spring 50, whereby the V-shaped cutouts 49 engage the truncated cone portions 60 of the fixing pins 56 maintaining the fixing pins 56 in the fixing holes 46 and affixing the thermal print head 24 to the head frame 34. After the thermal print head 24 has been affixed, electrical power and printing signal lines are connected to the head using a connector 72 provided on the head holder 52. Thus, the mounting of the thermal print head 24 on the head frame 34 can be accomplished very easily. The print head 24 can be detached from the head frame 34 by moving the fixing plate 48 in direction D, allowing the positioning pin 54 and fixing pins 56 to be withdrawn from the positioning hole 44 and fixing holes 46.

The method of printing on the paper 11 is now described. First, the head frame 34 is swung down so that the paper 11 is pressed against the platen roller 26 by the print head 24 mounted on the head frame 34. This inserts the pins 66 on the printer frame 14 into the openings 70 of the engaging members 68 on the head holder 52, and the head frame 34 is then clamped shut on the printer frame 14 by using the levers 36 to hook the hooked portions 38 onto the pins 40. The relative positions of the platen roller 26 and the print head 24 are correctly set by engaging the openings 70 with the engaging pins 66. Also, when the print head 24 is mounted on the head frame 34, the position of contact of the print head 24 with respect to the platen roller 26 is correctly established by inserting the pin 54 in the hole 44. The print head 24 can thus be correctly positioned with respect to the platen roller 26. This completes the preparation for the printing.

The stepping motor 32 is then activated to rotate the platen roller 26, and the paper 11 is printed by the print head 24 as the paper is transported between the print head 24 and platen roller 26. The engagement of the engaging members 68 with the engaging pins 66 limits turning movement by the print head 24 (FIG. 3), while the insertion of the pin 54 in the positioning hole 44 limits backward, forward and sideways movement of the print head 24. This arrangement enables the print head 24 to be affixed so it does not move during printing, even with a detachable mounting arrangement that might otherwise make it difficult to rigidly affix the print head 24 to the head frame 34. The rotation of the platen roller 26, the transporting of the paper 11 and other such operations do not therefore shift the print head 24 out of proper alignment with the platen roller 26. As a result, good quality printing can be obtained.

As the openings 70 are elongated in the direction in which the thermal print head 24 is brought into contact with the platen roller 26, changing the paper thickness only shifts the print head 24 perpendicularly with respect to the platen roller 26. This means that the contact between the print head 24 and the platen roller 26 can be maintained at a set angle. This enables good quality printing to be obtained.

As explained above, with the thermal printer according to this invention the correct relative positioning of the platen roller and the print head can be set by a first positioning mechanism that also enables print head turning movement to be restricted. Also, the correct position of contact of the print head with respect to the platen roller can be set by a second positioning mechanism that also enables backward, forward and sideways movement of the print head to be restricted.

As a result, the thermal print head can always be correctly positioned with respect to the platen roller. Moreover, this arrangement enables the print head to be affixed so that it does not move during printing, even with a detachable mounting arrangement that makes it difficult to rigidly affix the print head to the head frame. As a result, platen roller rotation, paper transport and other such operations do not cause faulty printing. This enables good quality printing to be obtained.

Also, engagement openings are elongated in the direction in which the thermal print head is brought into contact with the platen roller. This enables the contact between the print head and the platen roller to be maintained at a set angle, providing a further improvement in print quality.

The print head is mounted on a holder having a positioning member and engaging members symmetrically arranged at predetermined positions. This arrangement allows the print head to be moved vertically parallel to the platen roller. This produces better print quality than the conventional arrangement in which the print head can be inclined at a certain angle.

Although the present invention has been described in relation to a particular embodiment thereof, many other variations and modifications and other uses will become apparent to those skilled in the art. It is preferred, therefore, that the present invention be limited not by the specific disclosure herein, but only by the appended claims.

What is claimed is:

1. A thermal printer comprising:

a main frame; a rotatable platen roller supported on the main frame;

first print head engaging means on the main frame;

a print head frame mounted on the main frame and movable with respect to the main frame toward the platen roller for printing and openable away from the main frame;

a thermal print head detachably mounted on the openable head frame;

the print head including a holder having an end and a second engaging means at the end of the holder; a first positioning member located generally toward the center of the holder; and a first fixing member located to a side of the first positioning member;

a print head holder mounting plate connectable to the head frame and including a second positioning member which corresponds in position to the first positioning member so that they might be engaged; a second fixing member in position to engage the first fixing member;

the first and second engaging means, the first and second positioning members and the first and second fixing members all being respectively so positioned that upon respective engagement of each of the first and second engaging means, the first and second positioning members and the first and second fixing members, the print head is positioned relative to the platen roller for bringing the print head into contact with the platen roller to print paper between them; the first and second engaging means being structured and arranged to enable relative positioning of the print head above the platen roller for varying thickness paper to be printed; the first and second positioning members being engagable and being structured and arranged for setting the contact position of the print head on the platen roller and the first and second fixing members being engagable and being structured and arranged for setting a fixed position between the print head and the print head holder mounting plate and for urging the print head against the platen roller.

2. The thermal printer of claim 1, wherein there is a respective first engaging means at each end of the main frame and a respective second engaging means at each end of the holder for engaging the respective first engaging means there.

3. The thermal printer of claim 2, wherein there is a respective first fixing member at each side of the first positioning member on the print head holder and a second fixing member at each side of the second positioning member and in a position to correspond to the respective first fixing member.

4. The thermal printer of claim 3, wherein one of the first and second positioning members comprises a pin on one of the thermal print head holder and the head holder mounting plate, and the other of the first and second positioning members comprises a hole for receiving the pin enabling play in spacing between the print head holder and the head holder mounting plate but prohibiting shifting with reference to the position of the platen roller.

5. The thermal printer of claim 4, wherein one of the first and second fixing members comprises a respective projecting element and the other comprises a hole for receiving a projecting element; means on the projecting element for being fixed to the other of the print head holder and head holder mounting plate for fixing them against shifting in position relative to the platen roller while permitting adjustment of the spacing between the print holder and the mounting plate.

6. A thermal printer comprising a main frame; a rotatable platen roller supported on the main frame;

first and second print head engaging members on the main frame;

a print head frame mounted on the main frame and movable with respect to the main frame toward and away from the platen roller;

a respective engaging pin at each side of the main frame;

a thermal print head mounted on the print head frame;

the thermal print head including a holder having a respective engaging member at each end thereof in position to correspond with the respective engaging pins at the sides of the main frame when the holder is moved to the respective engaging pin;

a positioning member located generally in the center of the holder; a respective fixing member at each side of the positioning member on the holder;

a holder mounting plate having a respective positioning hole thereon in a position corresponding to that of the positioning member when the holder mounting plate and the holder are brought together; the holder mounting plate further having a respective fixing hole therein on each side of the positioning hole in a position corresponding to that of the respective fixing member on the print head holder, such that when the holder and the holder mounting plate are moved together, the positioning member is received in the positioning hole for positioning the contact location of the printing head on the platen roller and the fixing members are received in the fixing holes for fixing the orientation of the holder with respect to the holder mounting plate thereof;

the respective engaging pins engaging the engaging members for relatively positioning the plate roller and the print head and allowing there spacing apart dependent upon the paper that is printed between them.

7. The thermal printer of claim 6, wherein each of the engaging members is comprised of a fork including an engagement opening between the arms of the fork and the engaging pin on the printer frame is received between the arms of the fork such that when the print head is brought into contact with the platen roller, the print head is movable and guided by the engaging members for enabling adjustment of the spacing of the print head from the platen roller depending upon the paper therebetween without change to the orientation of the print head with reference to the platen roller.

8. The thermal printer of claim 7, wherein the engaging members are symmetrically located with respect to the positioning member on the head holder across the width of the print head.

9. The thermal printer of claim 6, wherein the engaging members are symmetrically located with respect to the positioning member on the head holder across the width of the print head.

10. The thermal printer of claim 9, further comprising means on the holder mounting plate for engaging the fixing members when they are installed at the holder mounting plate for holding the fixing members against moving out of engagement with the holder mounting plate.

11. The thermal printer of claim 5, wherein a compression spring is provided on the projecting element for urging the print head against the platen roller.

12. The thermal printer of claim 6, wherein each fixing member is provided with a respective compression spring to urge the print head against the platen roller.

* * * * *